US007891843B2

(12) United States Patent
Shin

(10) Patent No.: US 7,891,843 B2
(45) Date of Patent: Feb. 22, 2011

(54) LED LIGHTING DEVICE

(75) Inventor: Sung Ho Shin, Gwangmyeong-si (KR)

(73) Assignee: Hyundai Telecommunication Co., Ltd., Seoul (KR)

( * ) Notice: Subject to any disclaimer, the term of this patent is extended or adjusted under 35 U.S.C. 154(b) by 0 days.

(21) Appl. No.: 12/371,476

(22) Filed: Feb. 13, 2009

(65) Prior Publication Data

US 2010/0118537 A1 May 13, 2010

(30) Foreign Application Priority Data

Nov. 10, 2008 (KR) ..... 10-2008-0110976

(51) Int. Cl.
*F21S 8/00* (2006.01)

(52) U.S. Cl. ..... 362/268; 362/311.1; 362/329

(58) Field of Classification Search ..... 362/268, 362/299, 300, 296.07, 311.09, 311.1, 329, 362/336

See application file for complete search history.

(56) References Cited

U.S. PATENT DOCUMENTS

| | | | | |
|---|---|---|---|---|
| 3,711,702 | A | 1/1973 | Adra | |
| 5,458,505 | A | 10/1995 | Prager | |
| 6,361,192 | B1 * | 3/2002 | Fussell et al. | 362/331 |
| 6,446,706 | B1 | 9/2002 | Rosenfeld et al. | |
| 6,698,511 | B2 | 3/2004 | DiBene, II et al. | |
| 6,870,735 | B2 | 3/2005 | Genova et al. | |
| 6,966,666 | B2 * | 11/2005 | Liu | 362/101 |
| 7,572,036 | B2 * | 8/2009 | Yoon et al. | 362/331 |
| 2005/0111234 | A1 | 5/2005 | Martin et al. | |
| 2006/0193139 | A1 | 8/2006 | Sun et al. | |
| 2007/0230172 | A1 | 10/2007 | Wang | 362/249 |
| 2007/0230188 | A1 | 10/2007 | Lin | |
| 2007/0285926 | A1 | 12/2007 | Maxik | 362/294 |
| 2008/0024067 | A1 | 1/2008 | Ishibashi | |
| 2008/0049399 | A1 | 2/2008 | Lu et al. | |
| 2008/0186704 | A1 | 8/2008 | Chou et al. | 362/249 |
| 2008/0210407 | A1 | 9/2008 | Kim et al. | |

(Continued)

FOREIGN PATENT DOCUMENTS

DE 202006015980 U1 12/2006

(Continued)

OTHER PUBLICATIONS

Notice of Rejection, Korean Intellectual Property Office, dated Feb. 20, 2009, related to Korean Patent Application No. 10-2008-0110976, 10 pages.

(Continued)

*Primary Examiner*—John A Ward
(74) *Attorney, Agent, or Firm*—Seed IP Law Group PLLC

(57) ABSTRACT

An LED lighting device is provided, which does not create dazzling effects, has no difference in brightness in accordance with viewing angles, and has superior interior effects. The LED lighting device includes an LED irradiating light onto an outside, a first lens having a lower part in which the LED is provided and having a convex form to diffuse the light incident from the LED through the lower part thereof to the outside, and a second lens provided on the outside of the first lens and having a rough surface formed on its inner surface to diffusedly reflect the light diffused through the first lens.

14 Claims, 13 Drawing Sheets

U.S. PATENT DOCUMENTS

2008/0273319 A1* 11/2008 VanderSchuit ..... 362/101

FOREIGN PATENT DOCUMENTS

| | | | |
|---|---|---|---|
| EP | 0902231 | A2 | 3/1999 |
| EP | 1914470 | A1 | 4/2008 |
| EP | 2025922 | A2 | 2/2009 |
| KR | 200181797 | Y1 | 6/2000 |
| KR | 200336197 | Y1 | 12/2003 |
| KR | 200337344 | Y1 | 12/2003 |
| KR | 1020040018107 | A | 3/2004 |
| KR | 100496522 | B1 | 6/2005 |
| KR | 200404242 | Y1 | 12/2005 |
| KR | 200421191 | Y1 | 7/2006 |
| KR | 200427060 | Y1 | 9/2006 |
| KR | 100748074 | B1 | 8/2007 |
| KR | 1020080054177 | A | 6/2008 |
| KR | 1020080062086 | A | 7/2008 |
| KR | 1020080093284 | A | 10/2008 |
| WO | 02097884 | A1 | 12/2002 |
| WO | 2008093978 | A1 | 8/2008 |

OTHER PUBLICATIONS

Notice of Rejection, Korean Intellectual Property Office, dated Apr. 23, 2009, relating to Korean Patent Application No. 10-2008-0100393, 8 pages.

* cited by examiner

<Prior Art>

LED LIGHTING DEVICE

CROSS-REFERENCE TO RELATED APPLICATION

This application is based on and claims priority from Korean Patent Application No. 10-2008-110976, filed on Nov. 10, 2008 in the Korean Intellectual Property Office, the disclosure of which is incorporated herein in its entirety by reference.

BACKGROUND OF THE INVENTION

1. Field of the Invention

The present invention relates to an LED lighting device, and more particularly, to an LED lighting device, which does not create dazzling effects, has no difference in brightness in accordance with viewing angles, and has superior interior effects.

2. Description of the Prior Art

As lighting devices that receive power and convert electric energy into light energy, incandescent lamps and fluorescent lamps have been typically used. Although the incandescent lamp has a short lifespan and high power consumption, it has been widely used up to now since it does not require any incidental device for lighting and can be easily combined with a lighting fixture.

The fluorescent lamp has the efficiency higher than that of the incandescent lamp using filament and a long lifespan, and thus also has been widely used together with the incandescent lamp. Recently, iodine lamps using halogen cycle, high-efficiency halide lamps, and the like, have been developed and put to practical use.

On the other hand, since LED is small-sized, has a long lifespan, and directly converts electric energy into light energy, it has a low power consumption and high efficiency. However, since LED has a superior rectilinear propagation of light, but has a poor diffusion of light, it is unsuitable to use LED as an indoor lamp that requires irradiation over a wide area.

Also, as illustrated in FIG. 1 (which illustrates in vector form the quantity of light irradiated from LED around a light source), light irradiated from LED 10 has a difference in light quantity depending on its propagating path, and thus the brightness of light may also differ in accordance with the viewing angle. Accordingly, in the case of constructing a lighting device with LED, the light may not be irradiated uniformly. Also, when a user directly sees the light irradiated from LED 10, the cornea of the user's eye may be damaged.

SUMMARY OF THE INVENTION

Accordingly, the present invention has been made to solve the above-mentioned problems occurring in the prior art while advantages achieved by the prior art are maintained intact.

One object of the present invention is to provide an LED lighting device, which irradiates light over a wide area and makes light illumination uniform over the whole light transfer range, even though LED is used as a light source, by expanding the light transfer range through complement of rectilinear propagation of light irradiated from the LED.

Another object of the present invention is to provide an LED lighting device, which performs stereoscopic emission of light irradiated from LED, and has superior interior effects.

In order to accomplish these objects, there is provided an LED lighting device, according to an embodiment of the present invention, which includes an LED irradiating light onto an outside; a first lens having a lower part in which the LED is provided and having a convex form to diffuse the light incident from the LED through the lower part thereof to the outside; and a second lens provided on the outside of the first lens and having a rough surface formed on its inner surface to diffusedly reflect the light diffused through the first lens.

The first lens may have a first lens bottom surface to which the light irradiated from the LED is incident, a first lens side surface extending upward from the first lens bottom surface and configured in a manner such that a horizontal distance between the first lens side surface and a line, which starts from a center part of the first lens bottom surface and is orthogonal to the first lens bottom surface, is decreased as it goes upward, and a first lens upper surface extending in parallel from an upper end of the first lens side surface.

The length of the first lens in a height direction may be set to be longer than the length of the first lens in a width direction. The rough surface may be provided with a plurality of fine protrusions projecting toward the first lens so that the light diffused through the first lens is diffusedly reflected. In this case, the fine protrusion may be in a convex form or in a triangular cross-section.

On the other hand, a part of the second lens corresponding to the first lens upper surface may be depressed toward the first lens to have a U-shaped cross-section. In this case, the lower surface of the second lens part having the U-shaped cross-section may be thicker than the side surface of the second lens part. In addition, the second lens part corresponding to the first lens upper surface may project toward the first lens so that the second lens part becomes thicker.

On the first lens bottom surface, an accommodation groove for accommodating the LED may be formed, and a specified space may be provided between the first lens and the second lens. In the space, stereoscopic scattering assistants for assisting in light scattering may be provided.

In addition, a plurality of circular LEDs may be provided. In this case, the center part of the first lens may be hollowed in a height direction. A lens connection part for connecting the first lens bottom surface and the second lens may be further included, and a reflection plate for reflecting the light diffusedly reflected from the rough surface upward may be provided on an upper surface of the lens connection part.

According to the LED lighting device according to the present invention, the first lens is projected in a convex form toward a light traveling path, and thus the LED is changed from a point light source to a surface light source to expand the light transfer range.

In addition, according to the LED light device according to the present invention, since the light diffused through the first lens is diffusedly reflected through the rough surface of the second lens and then emitted to an outside, the light irradiated from the LED can be stereoscopic. Also, since the light irradiated from the LED passes through both the first lens and the second lens, the cornea of the user's eye may not be damaged even if a user directly sees the light irradiated from the LED.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Figure 1:
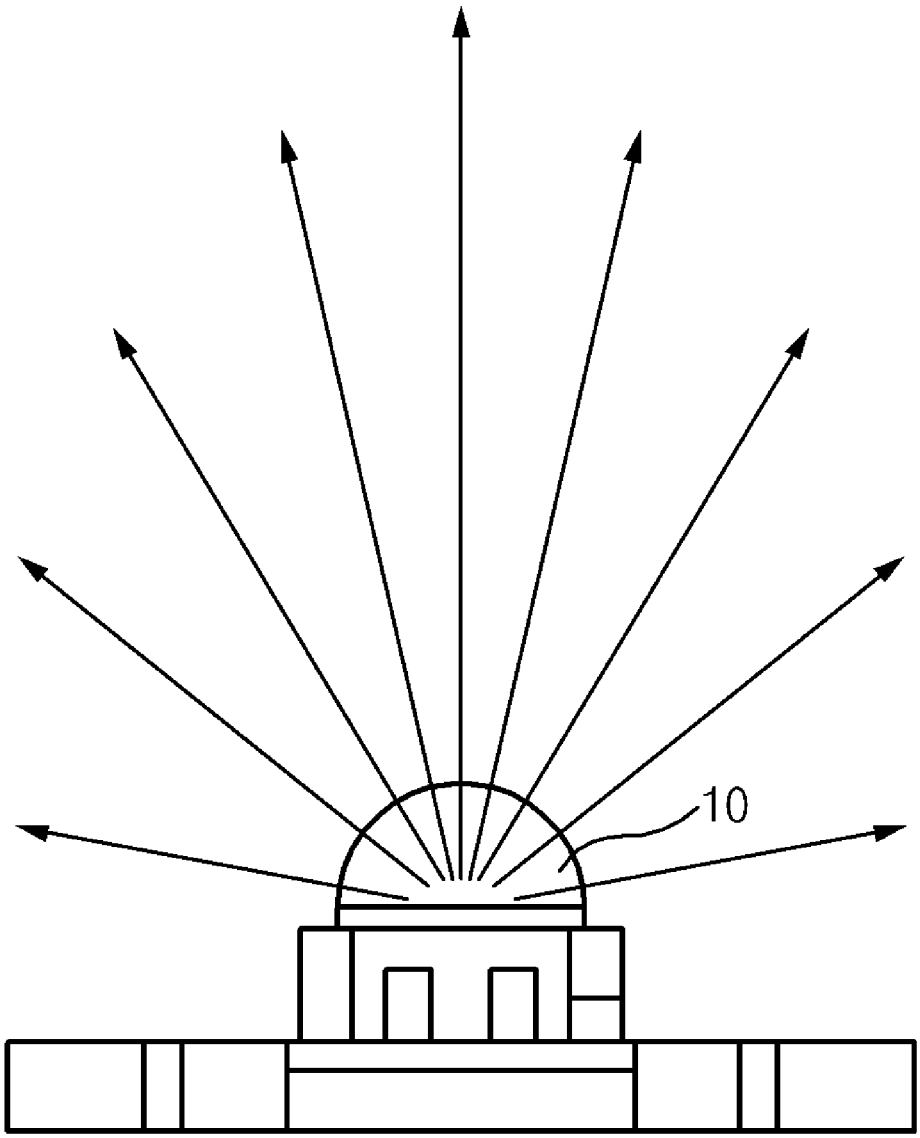
FIG. 1 is a view illustrating the quantity of light irradiated from LED around a light source in vector form.

Hereinafter, preferred embodiments of the present invention will be described in greater detail with reference to the accompanying drawings. In the following description, same drawing reference numerals are used for the same elements even in different drawings. The matters defined in the description such as a detailed construction and elements are nothing but the ones provided to assist in a comprehensive understanding of the invention. Thus, it is apparent that the present invention can be carried out without those defined matters. Also, well-known functions or constructions are not described in detail since they would obscure the invention in unnecessary detail.

First Embodiment

Figure 2:
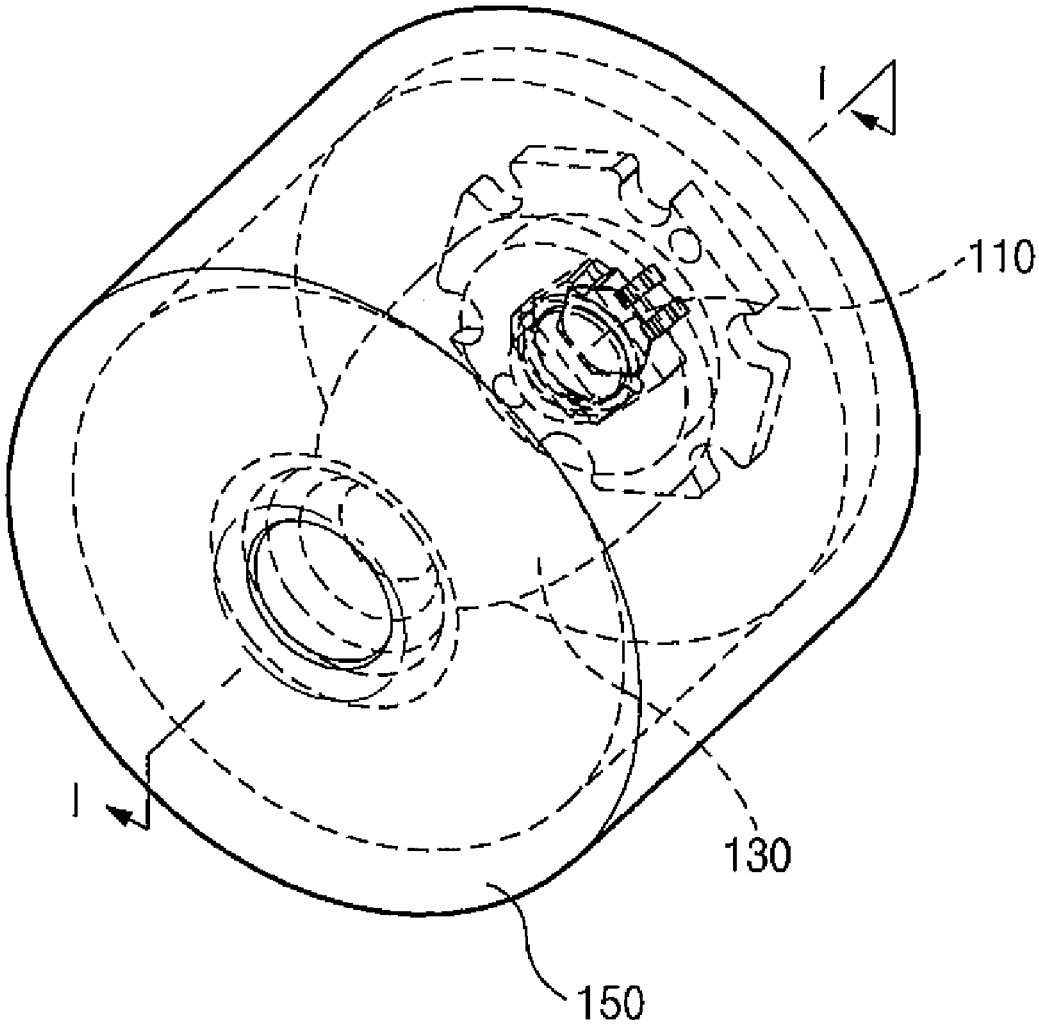
FIG. 2 is a perspective view illustrating an LED lighting device according to the first embodiment of the present invention.
Figure 3:
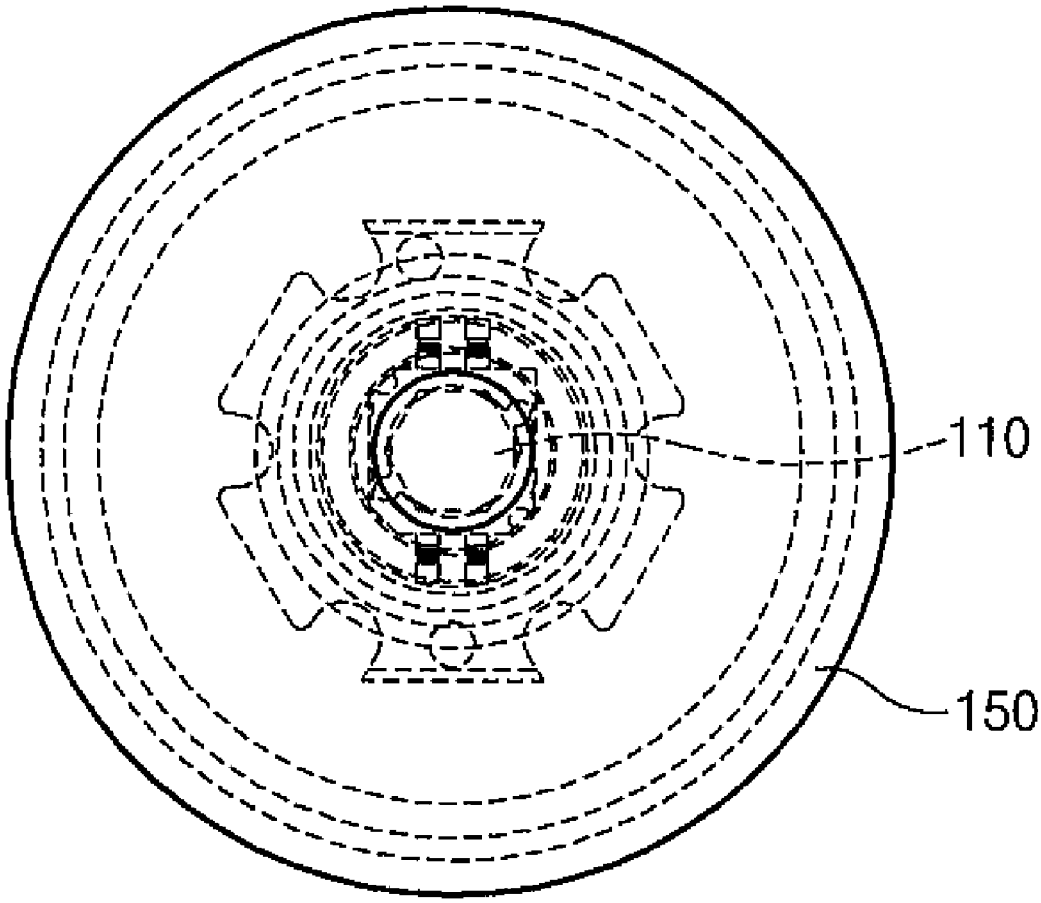
FIG. 3 is an opened-up view of the lighting device of FIG. 2 seen from the upper side thereof.

FIG. 2 is a perspective view illustrating an LED lighting device according to the first embodiment of the present invention. FIG. 3 is an opened-up view of the lighting device of FIG. 2 seen from the upper side thereof, and FIG. 4 is a sectional view taken along line I-I in FIG. 2.

Figure 4:
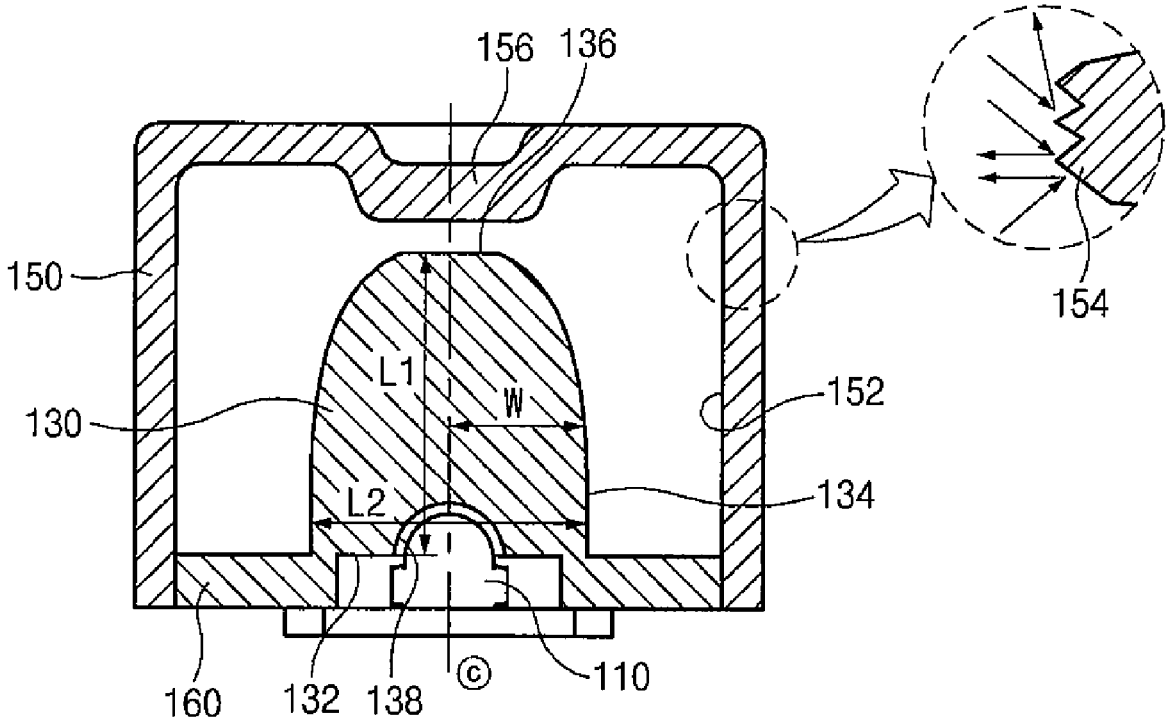
FIG. 4 is a sectional view taken along line I-I in FIG. 2.

As illustrated in FIGS. 2 to 4, an LED lighting device according to the first embodiment of the present invention includes an LED 110, a first lens 130, and a second lens 150.

Light irradiated from the LED 110 is incident from the bottom surface side of the first lens 130 to the first lens 130. For this, the LED 110 may be provided on the lower surface side of the first lens 130. Here, the lower surface side of the first lens 130 may means just below the bottom surface of the first lens 130. However, in the case where an accommodation groove 138 for accommodating the LED 110 is formed on the bottom surface of the first lens 130 (See FIG. 4), it may mean the side of the accommodation groove 138 formed on the bottom surface of the first lens.

On the other hand, the light incident to the first lens 130 through the lower surface side of the first lens 130 may be diffused to an outside of the first lens 130 through the first lens 130. For this, the first lens 130 may be formed in a convex form as illustrated in FIG. 4. That is, as illustrated in FIG. 4, the first lens 130 may be formed to project in a convex form toward a light traveling path (e.g. upward direction in FIG. 4). By such a form of the first lens, the light incident to the first lens 130 may be refracted from the outer interface of the first lens 130 to the outside and diffused as it passes through the first lend 130, and thus the light transfer range can be widened even if the LED 110 is used as a light source of the lighting device.

Also, the length L1 of the first lens 130 in a height direction may be set to be longer than the length L2 of the first lens in a width direction. By forming the first lens 130 as described above, the thickness of the first lens 130 through which the light irradiated from the LED 110 passes differs depending on the traveling path of the irradiated light, and thus the light irradiated from the LED 110 can be emitted to an outside with uniform illumination.

Figure 5:
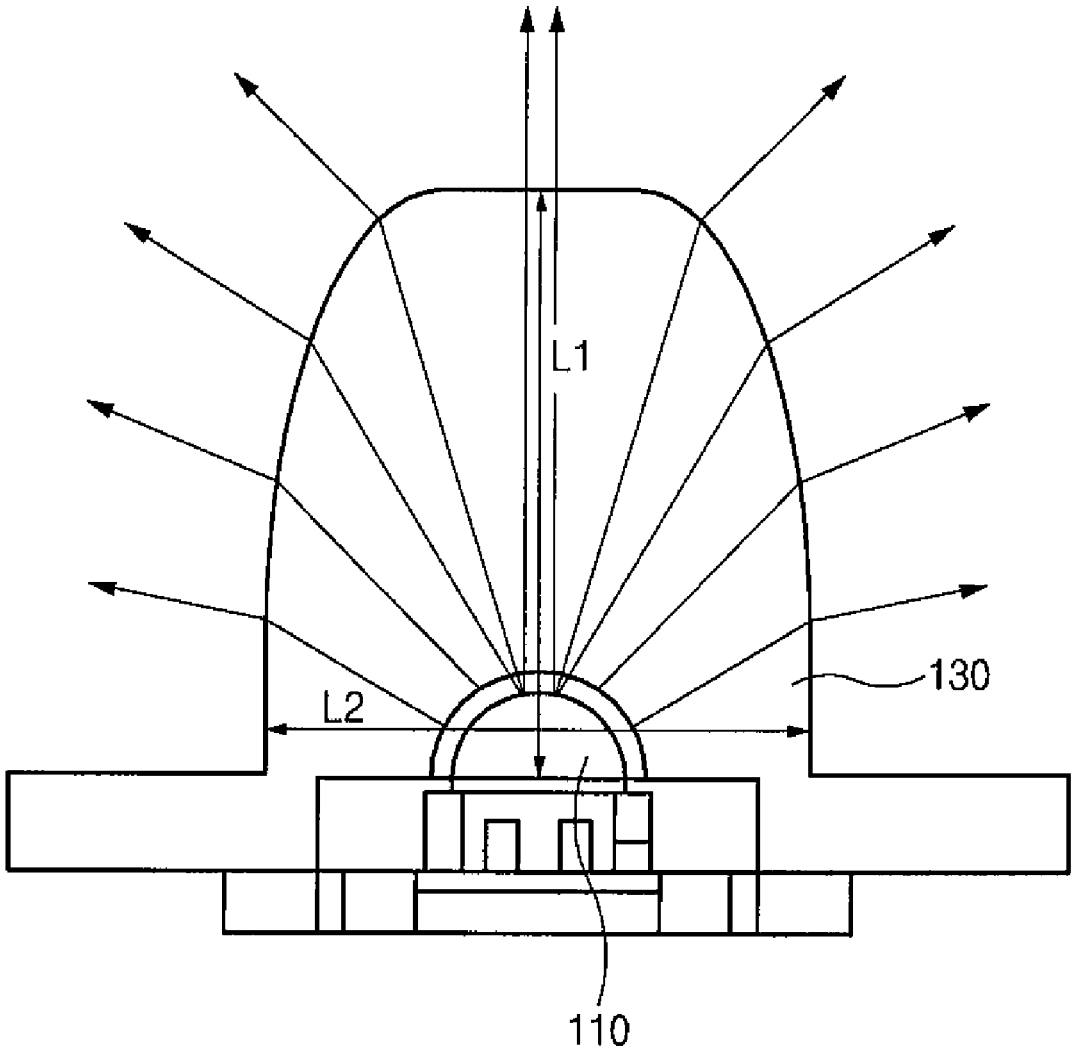
FIG. 5 is a sectional view illustrating a traveling path of light incident from LED to the first lens and the quantity of light according to the traveling path.

With reference to FIG. 5, the above described feature will be described in more detail.

FIG. 5 is a sectional view illustrating a traveling path of light incident from the LED to the first lens and the quantity of light according to the traveling path. In the case of the LED 110, the quantity of light traveling vertically upward (See FIG. 5) is largest, and as the angle of the light traveling path becomes larger, the corresponding quantity of light becomes smaller (See FIG. 1).

However, if the length L1 of the first lens 130, which surrounds the LED 110, in a height direction is set to be longer than the length L2 of the first lens 130 in a width direction, the strongest light passes through the thickest part of the first lens 130 while the weakest light passes through the relatively thin part of the first lens 130, resulting in that the strength of light according to the light traveling path can be corrected.

Accordingly, by forming the first lens 130 in the convex form toward the light traveling path (i.e. upward direction in FIG. 4) and setting the length L1 of the first lens in the height direction to be longer than the length L2 of the first lens in the width direction, the LED 110 is changed from a point light source to a surface light source, and the light irradiated from the LED 110 is emitted to an outside of the first lens 130 with the uniform quantity of light. However, the length of the first lens in the height direction may be limited depending on the size of the lighting device and soon, and in this case, the light traveling vertically upward still has illumination higher than that of the light traveling through other paths. Accordingly, there is a need for a means capable of adjusting the quantity of light without lengthening the length of the first lens in the height direction any more (such a means will be described later).

On the other hand, as illustrated in FIG. 4, the first lens 130 may include the first lens bottom surface 132, the first lens side surface 134, and the first lens upper surface 136. The first lens bottom surface 132 is a surface to which the light irradiated from the LED 110 is incident, and corresponds to the lower surface of the first lens 130. On the first lens bottom surface 132, an accommodation groove for accommodating the LED 110 may be formed.

The first lens side surface 134 extends upward from the first lens bottom surface 132, and is configured in a manner such that the horizontal distance W between the first lens side surface 134 and a line C, which starts from the center part of the first lens bottom surface 132 and is orthogonal to the first lens bottom surface 132, is decreased as it goes upward. The first lens 130 having the first lens side surface 134 may have a shape similar to a truncated cone. That is, the first lens 130 may be in the form of a body of revolution, of which the radius from the line C, which starts from the center part of the first lens bottom surface 132 and is orthogonal to the first lens bottom surface 132, to the first lens side surface 134 is gradually decreased. Accordingly, in the cross-section of the first lens 130, one side surface may be in the form of an arc having a gentle slope.

However, the shape of the first lens side surface 134 is not limited to the body of revolution, but any shape which can diffuse the light incident from the LED, i.e., which is configured in a manner such that the horizontal distance W between the line C and the first lens side surface 134 is decreased as it goes upward (i.e. upward in FIG. 4), can be adopted as the first lens side surface 134.

On the other hand, by adjusting the slope of the first lens side surface 134 (e.g. gentle slope or steep slope), the shape of the first lens side surface 134, i.e., the shape of one side surface of the first lens 130 (typically, in the form of an arc) can properly distribute the light diffused to the outside of the first lens 130.

At least a part of the light diffused as described above may be diffusedly reflected through a rough surface 152 of the second lens 150 provided on the outside of the first lens 130. The rough surface may be formed through a blast process or surface process. The blast process is a process of roughening the surface of a material by spraying a grinding material in the form of small particles onto the surface of the material at high pressure. The blast process may be classified into sand blast using sand as the grinding material, grid blast using grid made of copper as the grinding material, and shot blast using special steel as the grinding material.

By performing a proper blast process in accordance with the material of the second lens 150, the rough surface 152 is formed on the inner surface of the second lens 150. However, the forming of the rough surface 152 is not limited thereto, and the rough surface 152 may also be formed through a surface process such as an acid process. That is, the rough surface can also be obtained by corroding the inner surface of the second lens 150 through acid digests of the inner surface of the second lens 150.

Such s rough surface 152 may be formed over the whole inner surface of the second lens 150, or may be partially formed on a specified region. Whether to form the rough surface 152 on the whole or partially may be determined in accordance with the degree of reflection required for the light diffused from the first lens 130. If the partially formed rough surface 152 is sufficient for the diffused reflection of the light diffused from the first lens 130, in consideration of the shape of the first lens 130 (and the corresponding degree of light diffusion) or the light traveling direction, the rough surface 152 may be formed only on a specified region of the inner surface of the second lens 150.

In accordance with the rough surface forming method, the rough surface 152 may have diverse cross-sections, and a regular or irregular shape cross-section may be repeatedly formed. For example, the rough surface 152 may be formed in the form of a plurality of fine protrusions projecting inside the second lens 150. The fine protrusion 154, as illustrated in FIG. 4, may in a triangular cross-section. However, the shape of the fine protrusion 154 is not limited thereto. For example, the fine protrusion 154 may be in a convex form toward the inside of the second lens 150.

Referring to FIG. 4, the role of the rough surface 152 will be described. At least a part of the light diffused through the first lens 130 may be reflected in irregular directions by the fine protrusions 154 formed on the rough surface 152. Such reflection of the light may occur repeatedly, and as the light reflection occurs repeatedly, the light irradiated from the LED 110 may be stereoscopic. The stereoscopic light may be emitted to an outside of the second lens. In addition, since the light irradiated from the LED 110 should pass through both the first lens 130 and the second lens 150, the cornea of the user's eye may not be damaged even if a user directly sees the light irradiated from the LED.

On the other hand, in order to prevent the occurrence of a light loss during the reflection process, the LED lighting device according to the present invention may further include a reflection plate (not illustrated). Such a reflection plate may be provided on the upper surface of a lens connection part 160 that connects the first lens bottom surface 152 and the second lens 150. Even if the light reflected through the rough surface 152 travels in a direction where the light emission is not preferable, such as the rear surface of the lighting device and so on, the traveling light can be reflected again to the front surface by the reflection plate to minimize the light loss.

The position of the reflection plate is not limited to the upper surface of the lens connection part 160, but may be provided in a direction where the light emission is not preferable in accordance with the shape of the lighting device or the installation position of the lighting device. Also, the reflection plate may be provided on the whole upper surface or only on a part of the lens connection part 160. However, in the case where the light emission through the whole range of the lighting device including the rear surface of the lighting device is required, the reflection plate may not be provided.

On the other hand, a part 156 of the second lens 150 corresponding to the first lens upper surface 136 may be formed to be depressed toward the first lens 130. That is, as illustrated in FIG. 4, the part 156 of the second lens 150 corresponding to the first lens upper surface 136 may be formed to have a U-shaped cross-section. In this case, the lower surface of the second lens part 156 having the U-shaped cross-section may be formed to be thicker than the side surface of the second lens part 156. By forming the second lens 150 in this manner, the light illumination becomes uniform when the light traveling vertically upward, which still has illumination higher than that of the light traveling through other paths after it passes through the first lens 130, is finally emitted to an outside of the second lens 150.

Figure 6:
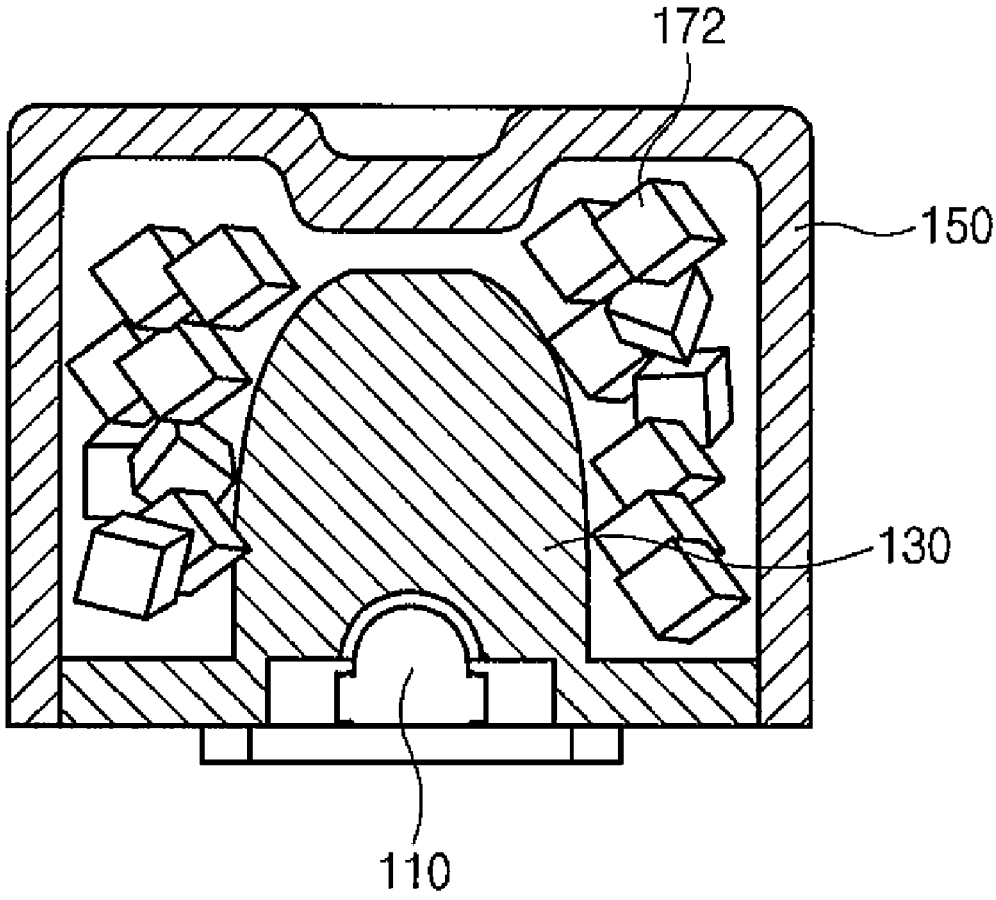
FIGS. 6 and 7 are sectional views illustrating an LED lighting device provided with scattering assistants in the space between the first lens and the second lens.
Figure 7:
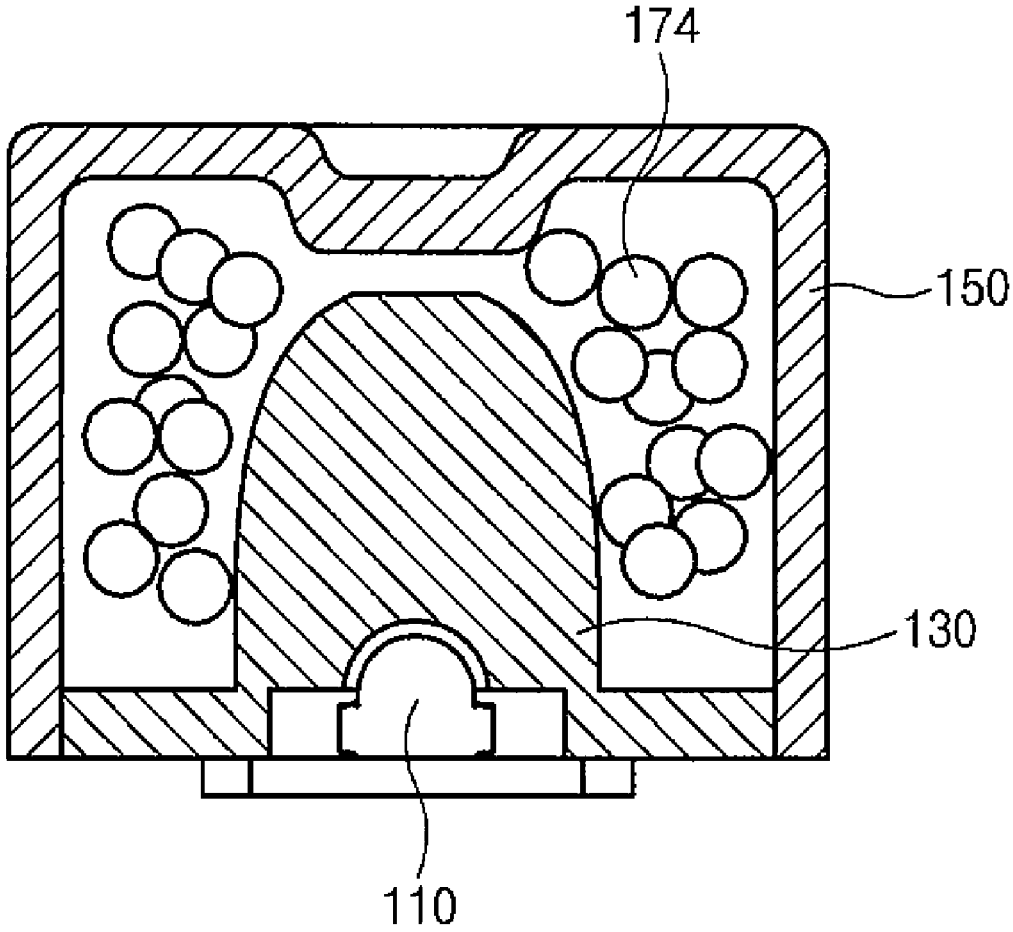

In order to add an interior effect to the LED lighting device according to the present invention, as illustrated in FIGS. 6 and 7, scattering assistants 172 and 174 may be included in a space between the first lens 130 and the second lens 150. FIGS. 6 and 7 are sectional views illustrating an LED lighting device provided with scattering assistants in the space between the first lens and the second lens. The scattering assistants 172 and 174 may be transparent cubic or glass beads having a stereoscopic shape. However, the scattering assistant is not limited thereto, but may be fluid that can assist in light scattering. Accordingly, the light diffused through the first lens 130 and the light reflected through the rough surface 152 of the second lens 150 may be scattered by the scattering assistants 172 and 174, and thus the light finally emitted to the outside of the second lens 150 can provide superior interior effects.

Second Embodiment

Figure 8:
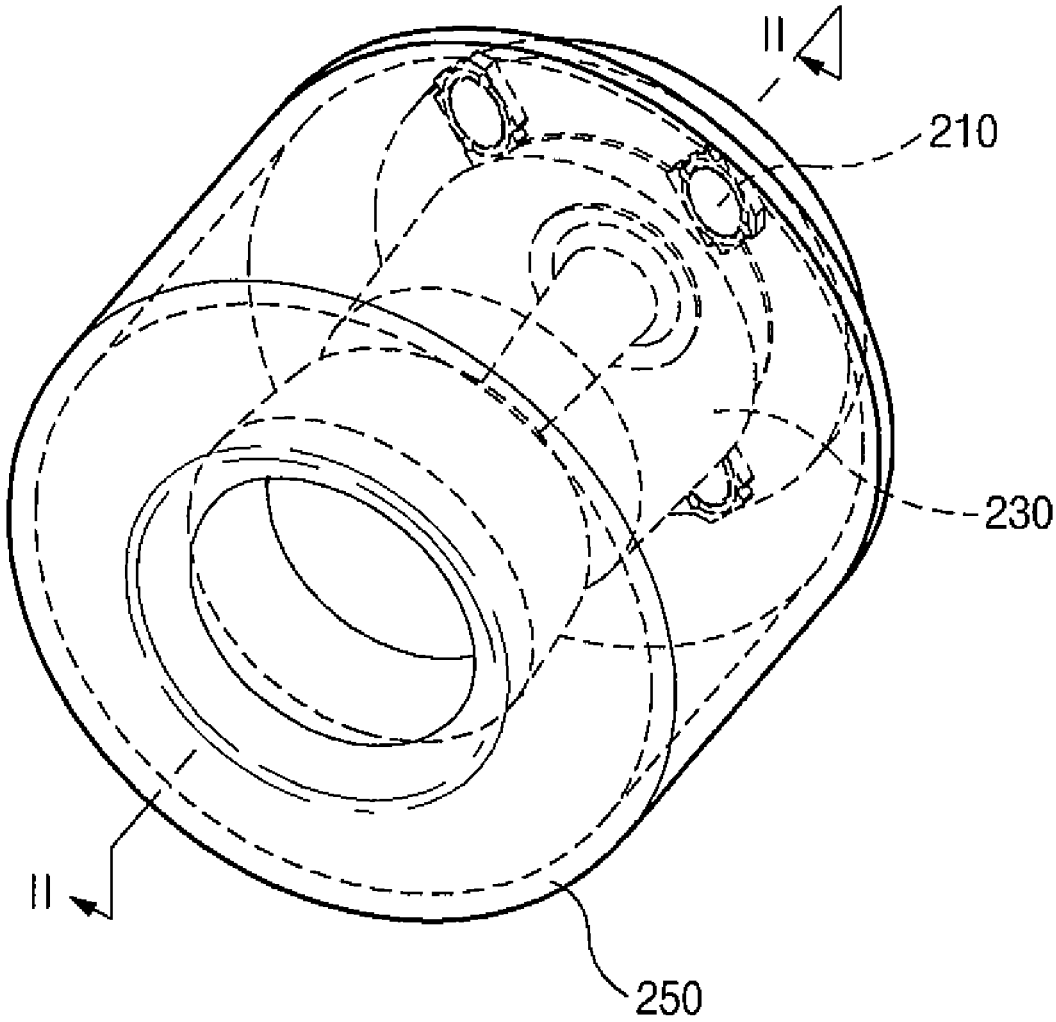
FIG. 8 is a perspective view illustrating an LED lighting device according to the second embodiment of the present invention.
Figure 9:
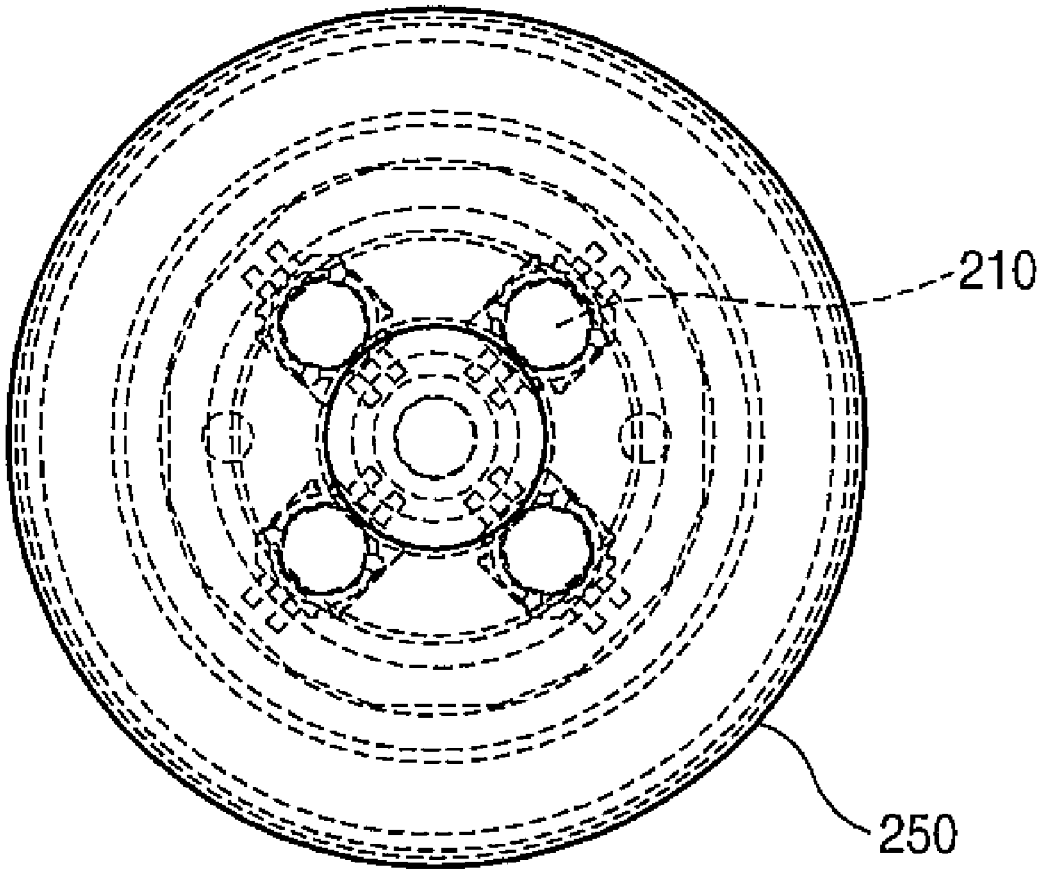
FIG. 9 is an opened-up view of the lighting device of FIG. 8 seen from the upper side thereof.

FIG. 8 is a perspective view illustrating an LED lighting device according to the second embodiment of the present invention. FIG. 9 is an opened-up view of the lighting device of FIG. 8 seen from the upper side thereof, and FIG. 10 is a sectional view taken along line II-II in FIG. 8.

Figure 10:
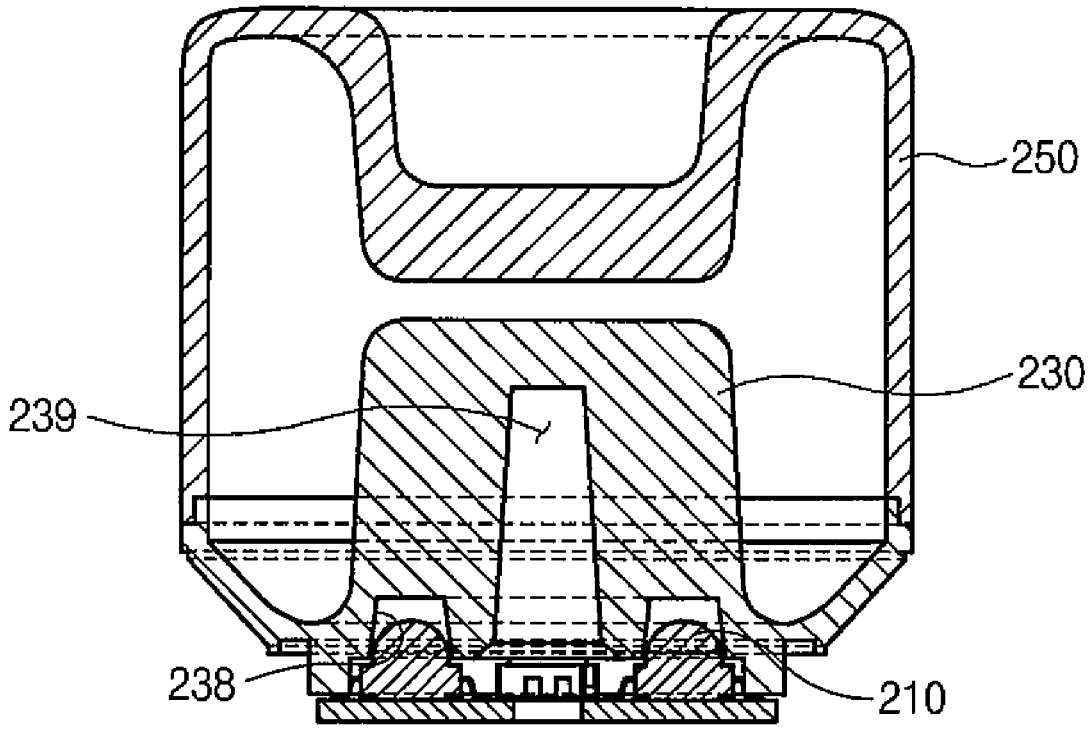
FIG. 10 is a sectional view taken along line II-II in FIG. 8.

As illustrated in FIGS. 8 to 10, an LED lighting device according to the second embodiment of the present invention includes an LED 210, a first lens 230, and a second lens 250. In the following description, the same (or equivalent) reference numerals are given to the same (or equivalent) parts as described above, and the detailed description thereof will be omitted.

In the LED lighting device according to the second embodiment of the present invention, four LEDs 210 are provided in circle. The LEDs 210 are arranged at the same interval around the center part of the lower surface of the first lens 230. In the second embodiment of the present invention, accommodation grooves 238 for accommodating the respective LEDs 210 are formed on the lower surface of the first lens 230.

In the second embodiment of the present invention, the shape and the function of the first lens 230 and the second lens 250 are similar to those of the first lens 130 and the second lens 150 in the first embodiment of the present invention. However, in the case of the first lens 230 according to the second embodiment of the present invention, unlike the first lens 130 according to the first embodiment of the present invention, a hollow portion 239 is formed in a height direction in the center part of the first lens 230. The shape of the hollow portion 239 is similar to the whole shape of the first lens 230, and the horizontal distance between the edge of the hollow portion 239 and a line, which starts from the center part of the lower surface of the first lens 230 and is orthogonal to the lower surface of the first lens 230, is decreased as it goes upward.

If the hollow portion 239 is formed in the inside of the first lens 230, the first lens 230 can be manufactured more easily. Typically, the first lens 230 is formed by injection molding, and if the whole size of the first lens 230 is enlarged due to the use of several LEDs 210, it may not be easy to manufacture the first lens 230 through injection molding. However, if the hollow portion 239 is formed in a height direction in the center part of the first lens 230, problems occurring in manufacturing the large-sized first lens 230 can be removed.

Third Embodiment

Figure 11:
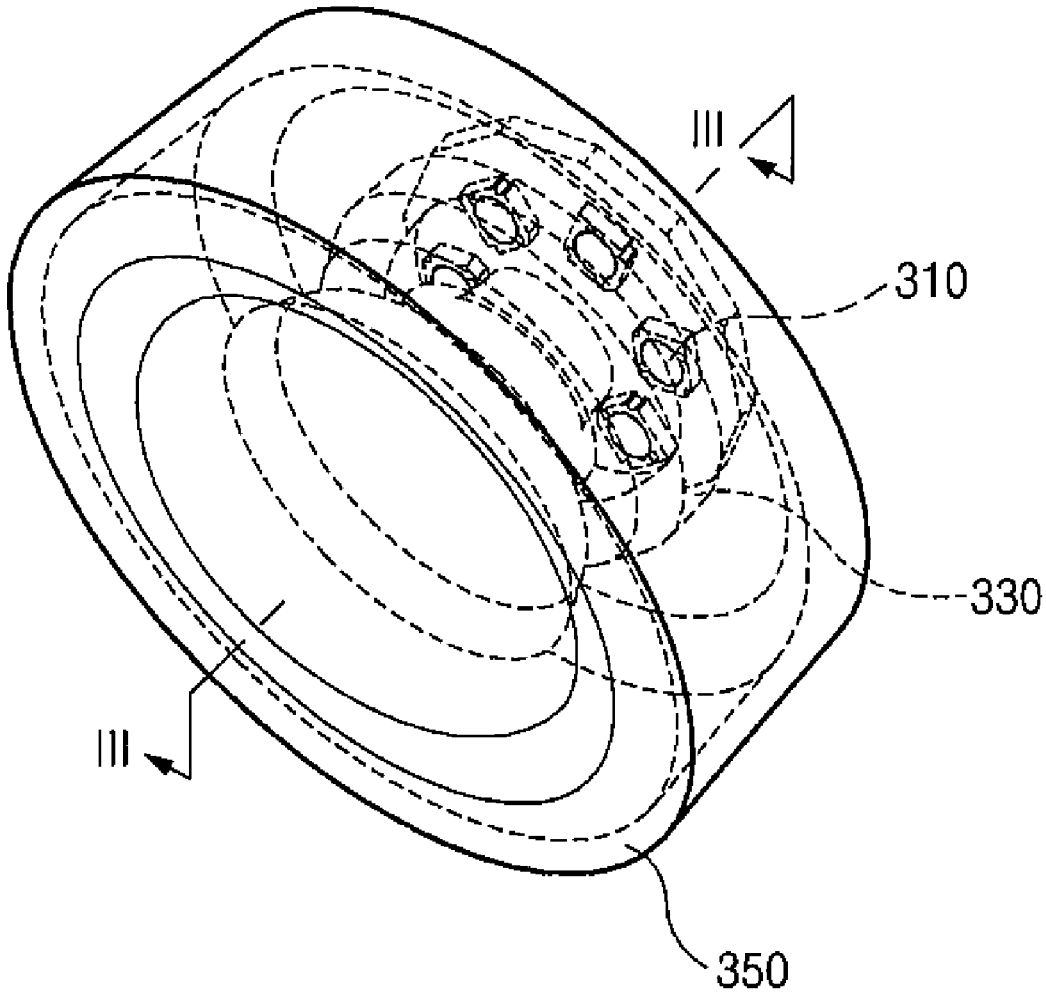
FIG. 11 is a perspective view illustrating an LED lighting device according to the third embodiment of the present invention.
Figure 12:
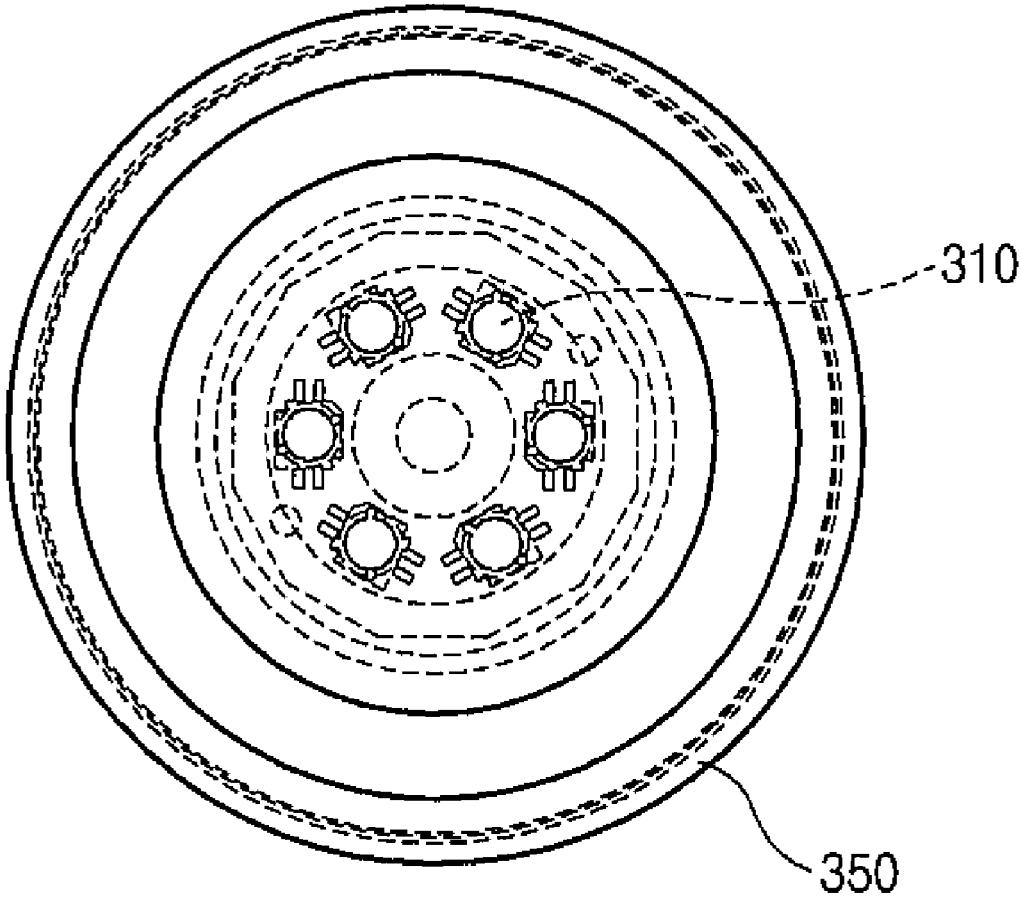
FIG. 12 is an opened-up view of the lighting device of FIG. 11 seen from the upper side thereof.

FIG. 11 is a perspective view illustrating an LED lighting device according to the third embodiment of the present invention. FIG. 12 is an opened-up view of the lighting device of FIG. 11 seen from the upper side thereof, and FIG. 13 is a sectional view taken along line III-III in FIG. 11.

Figure 13:
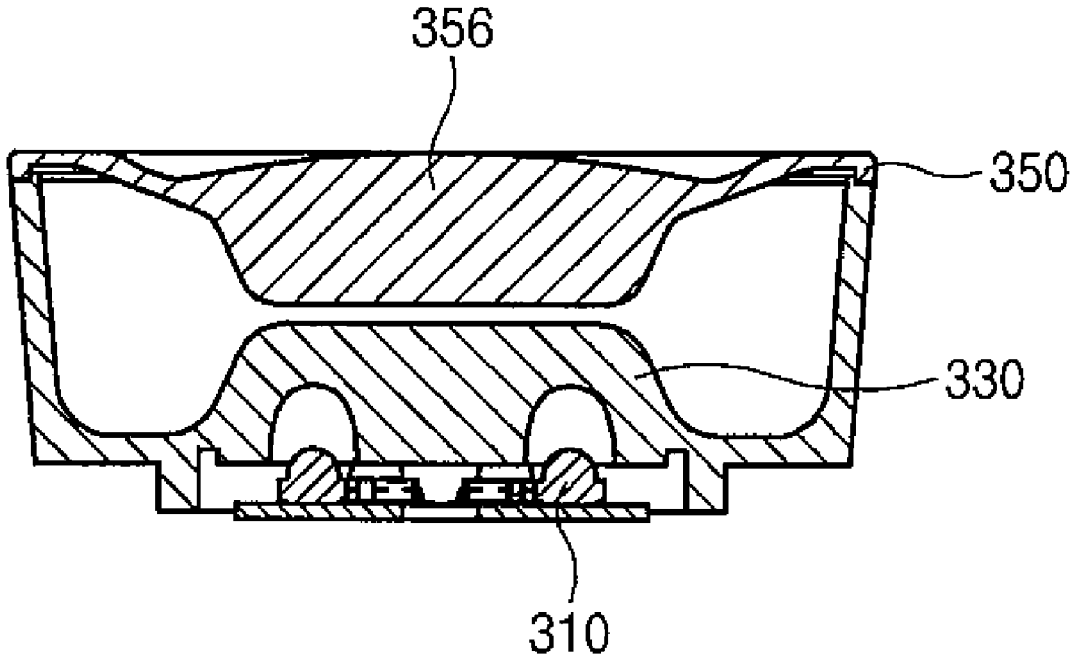
FIG. 13 is a sectional view taken along line III-III in FIG. 11.

As illustrated in FIGS. 11 to 13, an LED lighting device according to the third embodiment of the present invention includes an LED 310, a first lens 330, and a second lens 350. In the following description, the same (or equivalent) reference numerals are given to the same (or equivalent) parts as described above, and the detailed description thereof will be omitted.

In the LED lighting device according to the third embodiment of the present invention, six LEDs 310 are provided in circle. The LEDs 310 are arranged at the same interval around the center part of the lower surface of the first lens 330. In the third embodiment of the present invention, the shape and the function of the first lens 330 and the second lens 350 are similar to those of the first lens 130 and the second lens 150 in the first embodiment of the present invention. However, according to the third embodiment of the present invention, unlike the first lens 130 and the second lens 150 according to the first embodiment of the present invention, the length of the first lens 330 in a height direction is set to be shorter than the length of the first lens 330 in a width direction. In the case of the second lens 350, the part 356 of the second lens corresponding to the upper surface of the first lens 330 is formed to project toward the first lens 330.

The lighting device always has limitations in size and design. Due to such limitations, the sufficient height of the first lens 330 may not be secured. In this case, by forming the second lens part 356 corresponding to the upper surface of the first lens 330 to project toward the first lens 330, the illumination of the light irradiated from the LEDs 310 can be uniformly corrected. That is, by forming the corresponding part 356 to project toward the first lens 330 so that the second lens part 356 corresponding to the upper surface of the first lens 330 becomes thicker, the light, having passed through the first lens 330 vertically upward, should pass again through the second lens part 356 having a thickness thicker than other parts, and thus the whole light illumination can be uniformly corrected.

Although preferred embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. An LED lighting device comprising:

an LED configured to irradiate light external to the LED lighting device;

a first lens having a lower part in which the LED is provided and having a convex form to diffuse light incident from the LED through the lower part thereof, the first lens including:

a first lens bottom surface to which light irradiated from the LED is incident;

a first lens side surface extending upward from the first lens bottom surface and configured such that a horizontal distance between the first lens side surface and a line, which starts from a center part of the first lens bottom surface and is orthogonal to the first lens bottom surface, is generally decreased with increasing distance from the first lens bottom surface; and a first lens upper surface extending horizontally from an upper end of the first lens side surface; and a second lens provided on the outside of the first lens and having a rough surface formed on an inner surface thereof to diffusedly reflect light diffused through the first lens, the rough surface having a plurality of fine protrusions projecting toward the first lens so that light diffused through the first lens is diffusedly reflected, and a part of the second lens corresponding to the first lens upper surface having a U-shaped cross-section depressed towards the first lens.

2. The LED lighting device of claim 1 wherein a length of the first lens in a height direction is set to be longer than a length of the first lens in a width direction.

3. The LED lighting device of claim 1 wherein the fine protrusion has a convex form or a triangular cross-section.

4. The LED lighting device of claim 1 wherein a lower surface of the part of the second lens having the U-shaped cross-section is thicker than a side surface of the part of the second lens.

5. The LED lighting device of claim 1 wherein the part of the second lens corresponding to the first lens upper surface projects toward the first lens so that the part of the second lens becomes thicker.

6. The LED lighting device of claim 1 wherein, on the first lens bottom surface, an accommodation groove configured to accommodate the LED is formed.

7. The LED lighting device of claim 1, wherein a specified space is provided between the first lens and the second lens, and stereoscopic scattering assistants configured to assist in light scattering are provided in the space.

8. The LED lighting device of claim 1, wherein a plurality of circular LEDs are provided in circle.

9. The LED lighting device of claim 8, wherein a center part of the first lens is hollowed in a height direction.

10. The LED lighting device of claim 1, further comprising a lens connection part for connecting the first lens bottom surface and the second lens;

wherein a reflection plate for reflecting light diffusedly reflected from the rough surface upward is provided on an upper surface of the lens connection part.

11. A method for making an LED lighting device comprising:

enclosing an LED configured to irradiate light external to the LED lighting device at least partially within a lower part of a first lens, the first lens including:

a first lens bottom surface;

a first lens side surface extending upward from the first lens bottom surface and configured such that a horizontal distance between the first lens side surface and a line, which starts from a center part of the first lens bottom surface and is orthogonal to the first lens bottom surface, is generally decreased with increasing distance from the first lens bottom surface; and a first lens upper surface extending horizontally from an upper end of the first lens side surface; and enclosing the first lens at least partially within a second lens, the second lens having a rough surface formed on an inner surface thereof to diffusedly reflect light diffused through the first lens, the rough surface having a plurality of fine protrusions projecting toward the first lens so that light diffused through the first lens is diffusedly reflected, and a part of the second lens corresponding to the first lens upper surface having a U-shaped cross-section depressed inwardly.

12. The method for making an LED lighting device of claim 11, further comprising:

connecting the first lens to the second lens via a lens connection part.

13. The method for making an LED lighting device of claim 11, further comprising:

providing a reflection plate between the first lens and the second lens to reflect light diffusedly reflected from the rough surface of the second lens upward.

14. The method for making an LED lighting device of claim 11, further comprising:

providing stereoscopic scattering assistants in a space between the first lens and the second lens.

* * * * *